US005351450A

United States Patent [19]

Moskowitz

[11] Patent Number: 5,351,450

[45] Date of Patent: Oct. 4, 1994

[54] ARRANGEMENT FOR INCARCERATION PROVIDING SELF SUFFICIENT ISOLATION

[76] Inventor: Andrei Moskowitz, 265 W. 72nd St., New York, N.Y. 10023

[21] Appl. No.: 948,325

[22] Filed: Sep. 22, 1992

[51] Int. Cl.[5] ..... E04H 3/08

[52] U.S. Cl. ..... 52/106; 52/79.1

[58] Field of Search ..... 52/106, 79.1, 745.05, 52/79.7, 79.8, 79.9, 79.12

[56] References Cited

U.S. PATENT DOCUMENTS

| | | | |
|---|---|---|---|
| 229,540 | 7/1880 | Maetzel | 52/106 |
| 469,635 | 2/1892 | Hale | 52/106 |
| 1,614,336 | 1/1927 | Youngblood | 52/106 |
| 1,967,511 | 7/1934 | Meyer | 52/106 |
| 2,156,859 | 5/1939 | Lowe | 52/106 |
| 2,323,455 | 7/1943 | Creech | 52/106 |
| 4,970,834 | 11/1990 | Polson | 52/106 |
| 5,070,661 | 12/1991 | Lo Guidici | 52/29.1 |

*Primary Examiner*—Carl D. Friedman
*Assistant Examiner*—Kien Nguyen

[57] ABSTRACT

A system of self-sufficient isolated incarceration for housing and rehabilitating inmates comprising dwelling units, each sufficiently secured with barriers such as fences and monitored to prevent escape or injury. The dwelling includes facilities for day-to-day self-sufficiency, including such things as utilities, furniture, and utensils to enable the inmate to be responsible for such things as preparation of food, clothing needs, and the maintaining of the dwelling and the surrounding exterior area. Communication capabilities are provided, such as telephone, radio, and television to enable the inmate to participate in educational, social, entertainment and therapeutic activities.

2 Claims, 4 Drawing Sheets

ARRANGEMENT FOR INCARCERATION PROVIDING SELF SUFFICIENT ISOLATION

TECHNICAL FIELD

The present invention is directed to an arrangement for and a method of incarcerating criminal prisoners, and more particularly, to a system for rehabilitating the criminal by isolating him from physical contact with other people, while providing an enriched physical environment designed to enable the prisoner to be largely self-sufficient during incarceration—in such areas as preparation of food, maintaining personal hygiene, clothing selection and cleaning, dwelling maintenance, and the use of communication technology for the purposes of educational, entertainment, social, and therapeutic contact.

In essence, the invention incorporates all the security advantages of isolation, for both the inmate and the custodial staff, and avoids the disadvantages by enlarging the isolated space to the point of humane livability, and turning the space into a potential canvas for rehabilitative creativity. At the same time the invention makes full use of modern communication technology to ameliorate loneliness, enhance custodial efficiency and security, and further enlarge the convicts scope for self-improvement through contact with other inmates and the outside world.

It is important to emphasize that isolation has historically been considered a punitive last resort, and all rehabilitative efforts in the last two hundred years have been in the context of congregate systems. With this system we wish to make the case that a specially designed isolate environment is precisely the way to rehabilitate the prisoner, while regaining societal control over the chaos and savagery of current prison life.

The superiority of a new prison system stands or falls on how well it handles a certain class of human beings. Therefore, the following specification must necessarily present, in addition to a purely technical description of structure, an extended discussion of how people are to be handled within this system, and how they are likely to react to the prison environment in general, and the environment of this invention in particular.

BACKGROUND OF THE INVENTION

By the 19th century, accepted methods of dealing with criminals had shifted, in this country and in much of the industrial world, from the physical tortures of medieval times to physical confinement as a mode of punishment. Early in the 19th century two distinct and competing methods of incarceration were in operation in the United States: The Pennsylvania System, developed by the Quakers many years before, involving the total isolation of prisoners in small individual cells, with occasional solitary release for exercise and hygiene, and occasional visits by clergy and such. Its competitor was the Auburn System, or congregate system, which became the forerunner of the modern penitentiary.

Not surprisingly, the Pennsylvania System, by its cruel isolation, mutilated prisoners in a way unacceptable even by 19th century standards. After much debate and experimentation, the system was discredited and abandoned by mid-19th century. Aside from its psychological cruelty, the Pennsylvania system cost, in 1833, eighteen times as much per inmate as the Auburn System.

Surprisingly, the Pennsylvania system seems to be making a small comeback in its classic form. In a desperate effort to isolate certain prisoners for their protection, or because of extreme recalcitrance, or uncontrollable gang influence, a few systems have sprung up that involve isolated cell life 24 hours a day, with occasional short periods of solitary exercise, shower, and other necessities. Two examples are at Pelican Bay in California, and the maxi-maxi facility at Elmira, N.Y., which suffered a riot in 1991. An inmate at Pelican Bay, recently interviewed on 60 Minutes, finds conditions so unbearable that he is seeking the death penalty in Texas on unrelated charges.

In fact, aside from these examples of entire facilities designed to isolate inmates, a substantial portion of inmates in standard, congregate institutions spend most or all of their terms in Protective Custody isolation. The total percentage of isolated inmates, at any given time, ranges from 4% to 17% in various states.

Isolate prisons are the exception. Most of the approximately 1.1 million state and federal prisoners in this country are in penitentiaries of the congregate form. This number represents a massive expansion of prison population from 285,000 in 1977. In addition to these 1.1 million prison inmates, over 500,000 are in jails, where they await disposition or serve short sentences. Beyond these are about three million people under probation or parole. The fact that the crime rate has reached record levels in tandem with prison population indicates that most of the people in the habit of committing serious crimes are not behind bars.

To expand prison capacity and the rest of the criminal justice system to accommodate additional millions is a financially daunting prospect. Typical costs for each additional convict-space are on the order of $100,000, and annual per capita expense is typically $20,000, with certain facilities, such as Rikers Island in New York City, running as high as $60,000 per year per inmate. It is worth keeping in mind that, very roughly, it costs the income of the average American wage earner to incarcerate the average prisoner, and each additional space runs for about the same amount as a new single family home.

Even with the massive expansion of prison capacity in recent years, the current systems seem perpetually on the verge of collapse. Most states, under court order to reduce crowding, resort to early release to a greater or lesser extent. Despite the current boom in prison construction, our 1.1 million guests are living under conditions designed for far fewer.

The "modern" penitentiary has a long and conflicted history and is a distillation of many influences: various penal theories; popular anger, compassion, neglect; wide ranges in fiscal capacity and will. The result is a high-security institution that effectively separates its dangerous population from the larger society, but cannot protect its members from each other. It is an extremely expensive and complicated institution, requiring a large cadre of corrections personnel. These guards enter into a strange and convoluted relationship with the convict population, a relationship that corrupts and brutalizes both sides. This relationship often involves the ordainment of "trusted inmates", or implicit deals with powerful gangs, resulting in hierarchies of power and favor. Extreme cycles of authority transfer, and the attendant corruption, inevitably lead to explosions. There have been about 300 prison riots in the last twenty years.

The modern penitentiary offers a host of tortures and punishments that society will readily admit it has no right to inflict on any person, regardless of his crime. The worst of these include personal and gang terrorism, extortion, rape, slavery, and murder. That society cannot, despite the unbelievable expense, guarantee the average convict against these horrors is a profound indictment. Pretending that deprivation of freedom is all there is to a prison sentence today is a dark hypocrisy. Insecurity is constant and pervasive, for strong and weak alike.

In recent decades the courts have taken an interest in prison conditions, and have mandated changes where conditions were deemed inhumane. Many of the worst systems have been improved, despite great institutional resistance, but a sense of futility has pervaded the process. There is a sense in the country, and among experts, that the courts are trying to reform a system that is fundamentally flawed.

I believe that a fresh look at penitentiary design is called for. The question I wish to pose is this: assuming that the criminal is to be confined, can we devise a system that, as its guiding principle, incorporates many of those positive aspects of confinement that contribute, in the ordinary citizen, to the improvement of his life; and conversely, can we dispense with those aspects of confinement that are pointlessly destructive of life and spirit, and in the end do not serve any of society's purposes in incarceration? In other words, can prisons be designed so that confinement leans more toward the quality of discipline rather than torture?

The system I propose, which will be referred to herein as Self Sufficient Isolation (SSI), has the following strategy:

A) To physically (but not otherwise) isolate inmates from each other.

B) To design an environment for each inmate rich, varied, and flexible enough to permit him, given will and discipline, to better himself under conditions of relative dignity.

C) To make the system affordable to construct and maintain.

The system I envision, and which I will elaborate in detail, is relatively cheap, at least as effective from a security standpoint, and infinitely more humane than present methods. It is a system that a person could leave his mother in for two months without concern (but not, perhaps, without recriminations), and yet can accommodate the most dangerous inmates.

The key to the malignancy of today's prisons lies in permitting convicts to congregate. Just as small amounts of relatively benign radioactive material become dangerous when brought together, convicts who are relatively easy to deal with individually suddenly require extraordinary precautions when massed. If congregation could be eliminated without bringing back the horrifying effects of isolation, I believe we would have the basis of a new order with unthought of benefits.

SUMMARY OF THE INVENTION

A prison complex in accordance with the invention comprising a plurality of stand-alone dwellings each suitable for providing extended and uninterrupted occupancy by a single inmate, each such dwelling thus including means for enabling the inmate to completely care for himself subject only to the regular delivery to him of various staples, each of the dwellings being surrounded by a see-through barrier preventing egress of the inmate while allowing observation of the dwelling, the plurality of dwellings being disposed in an array of adjacent units allowing individual access to each of the units and visual and oral communication between inmates of adjacent units, and each of the dwellings including communication means connected to a control means providing monitorable and controllable communication to and from the inmates.

A method aspect of the invention comprises operating the prison complex in a manner described hereinafter for providing a stable, humane and safe incarceration while maximizing the possibility of rehabilitation of the inmates.

BRIEF DESCRIPTION OF THE DRAWINGS

The foregoing and other features and advantages of the present invention will be more readily appreciated as the same becomes better understood from the detailed description taken in conjunction with the following drawing, wherein.

DESCRIPTION OF PREFERRED EMBODIMENTS OF THE INVENTION

The system of incarceration of the present invention, which will be referred to herein as self-sufficient isolation (SSI), has the following strategy:

1) To physically (but not otherwise) isolate inmates from each other;

2) To design an environment for each inmate that is rich, varied and flexible enough to permit the inmate, given the inmate's will and discipline, to improve and rehabilitate under conditions of relative dignity;

3) To make the system affordable to construct and maintain.

Figure 1:
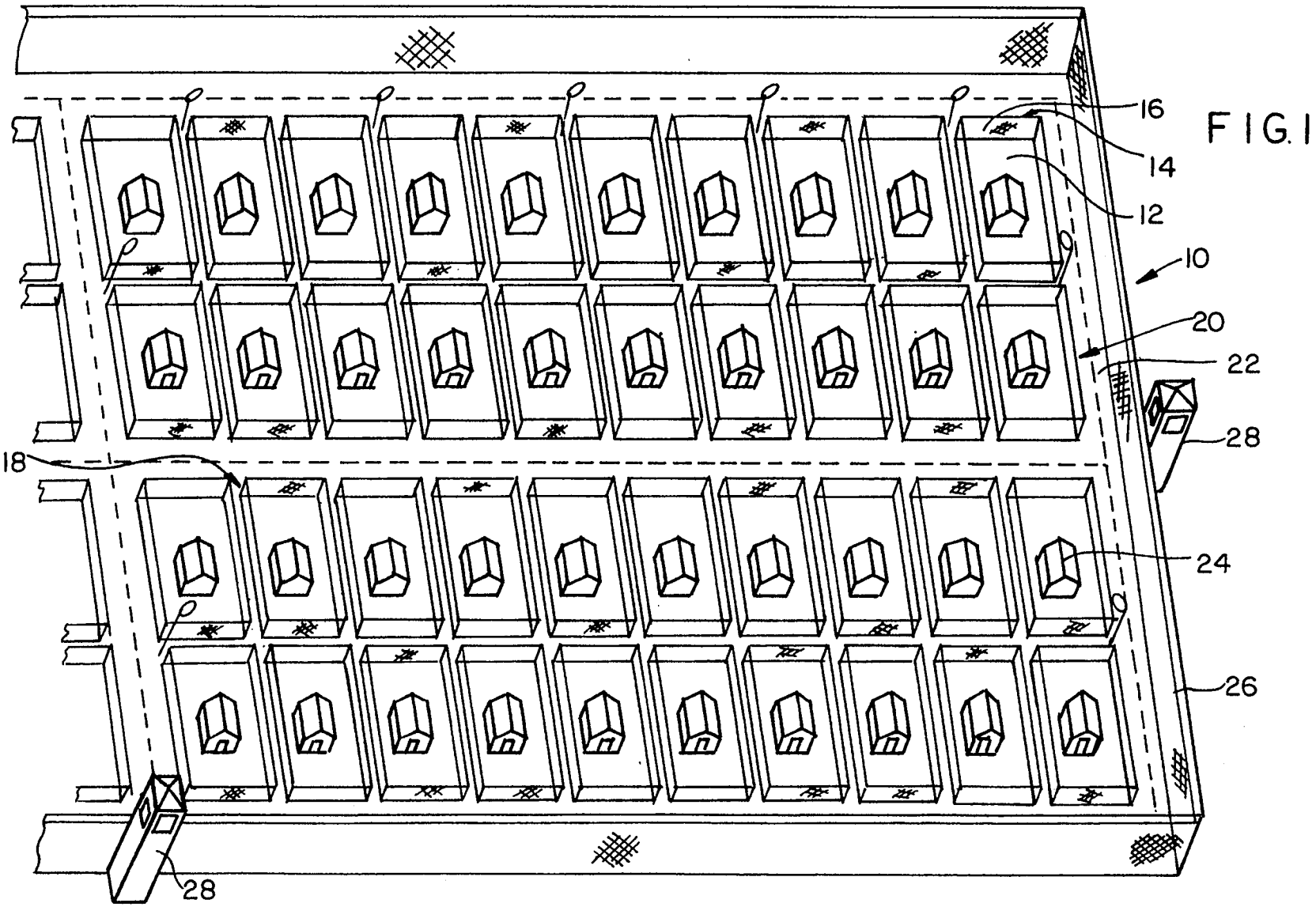
FIG. 1 is an isometric view of a compound formed of multiple isolated dwellings constructed and used in accordance with the method of the present invention.

Briefly, and with reference to FIG. 1, SSI begins with a large tract of reasonable flat, marginal land of the type that is abundant in the mountain and western states. A compound 10 constructed on the land consisting of individual plots 12 of approximately 40 feet by 80 feet. The plots 12 are separated from each other by double chain link fencing 14, flanged and topped with razor wire 16, for the most secure version of the system. Preferable, the gap 18 between the fences of adjacent plots 12 should be about feet. Ideally, the plots are organized in blocks 20 of approximately twenty, in a rectangle of ten by two plots 12. Service roads 22 define the blocks.

Constructed on each plot 12 is a hut or cabin 24 of approximately 15 feet by 20 feet. The cabin 24 might be assembled from large prefabricated parts, all fireproof. Provision can be made distinct designs that are appropriate to the climate of the location.

Constructed on each plot is a hut or cabin of approximately fifteen by twenty feet, with the sort of clustered arrangement of groups of four cabins indicated in FIG.

2, to facilitate utility access and maximize useable outdoor space within each plot. The cabin might be assembled from large prefabricated parts, all fire-proof. Provision can be made for distinct designs that are appropriate to the climate of the location.

Figure 4:
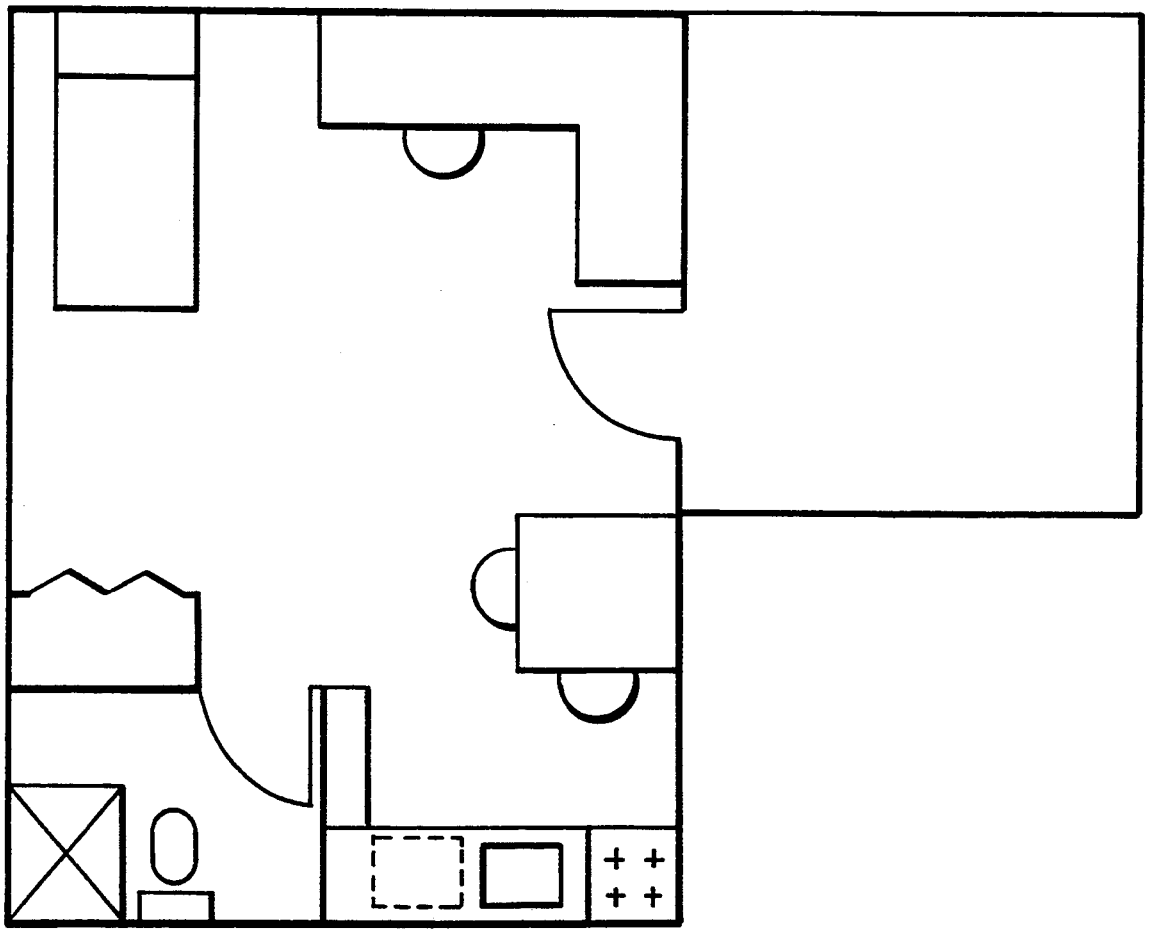
FIG. 4 is a plan view of the interior of the cabin.

Each cabin (FIG. 4) would generally consist of one room, with a partitioned shower and toilet area. Standard utilities are supplied, i.e. hot and cold water, electricity, sewerage, and an appropriate heating system. Also, as described later, telephone, video cable, and computer lines are supplied. Sturdy and simple furnishings would be included, i.e. a bed, table, chairs, and shelving, and a video-electronic workstation. Although the cabin itself has no security function, each cabin should be built so that it is not easily vandalized.

The cabin has an attached, outdoor slab, or deck, suitable as a work platform or sitting area.

Figure 2:
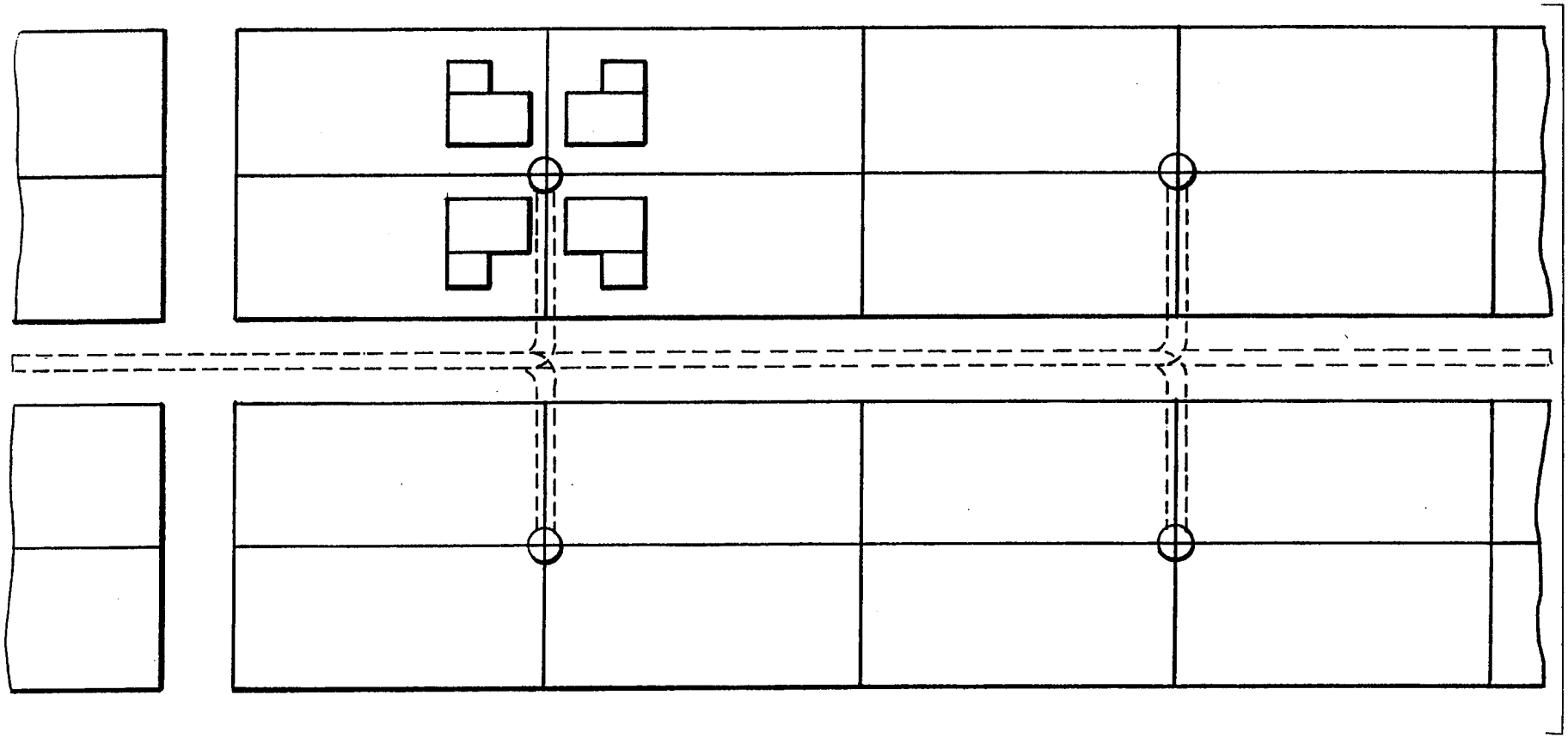
FIG. 2 is a plan view of part of a block of eight plots, showing the preferred arrangement of cabins within plots, and connection of utility lines to clusters of cabins.

In one arrangement, as shown in FIG. 2, the plots are arranged in rows of pairs of back-to-back (but spaced apart) plots, with each row of paired plots being spaced from an adjacent row by a preferably straight roadway. Utilities for all the plots are provided via trenches extending beneath the roadways and lateral branches extending to each plot.

Figure 3:
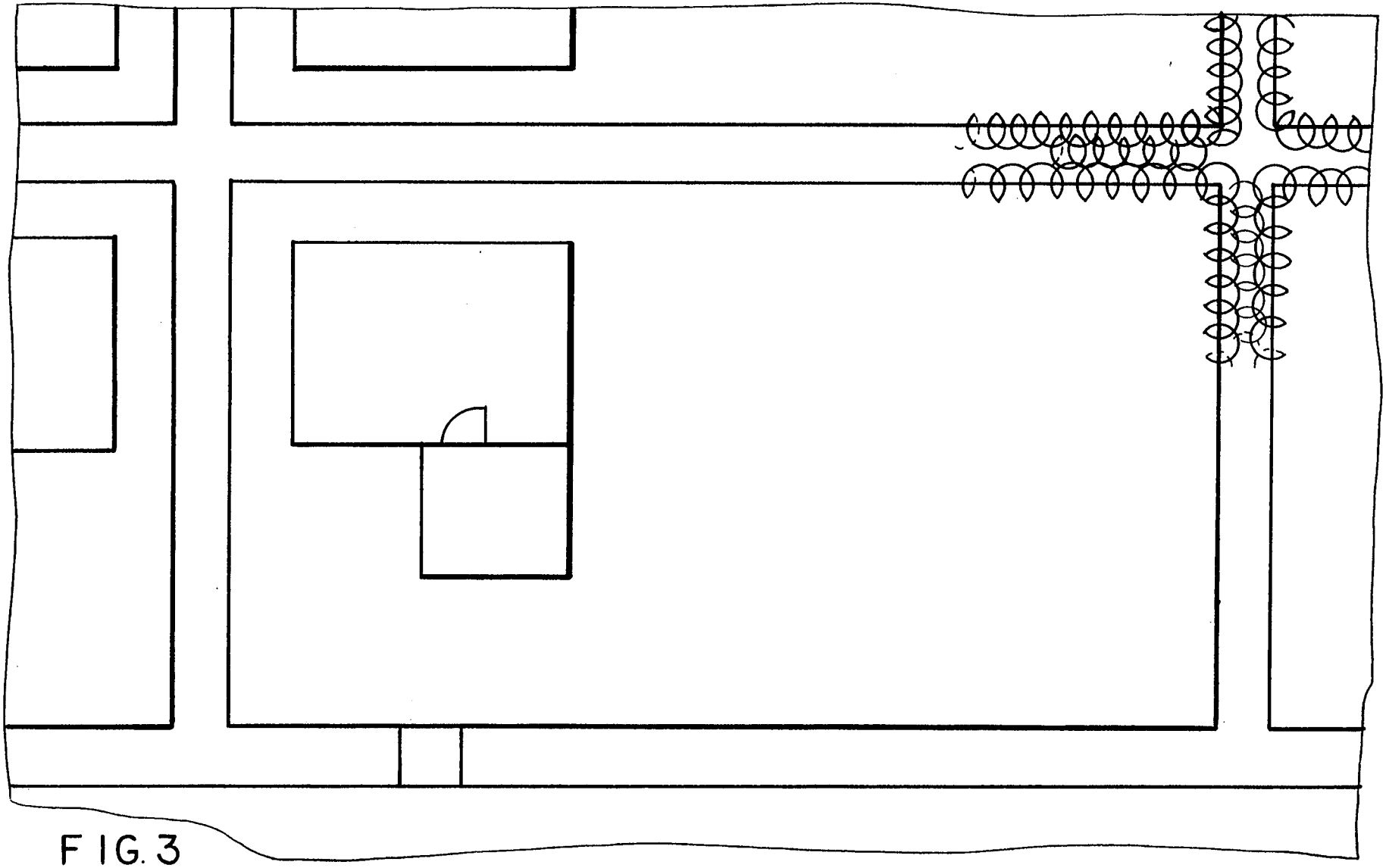
FIG. 3 is a plan view of a plot in the prison compound, with adjacent roadway and parts of adjacent plots.

As shown in FIG. 3, each plot is completely enclosed by a chain link fence (preferably topped with razor wire) and each row of plots is further separated from the row-separating roadways by a second fence.

The goal of SSI is maximum creative autonomy for each inmate All inmates must eat, and, like the rest of us, value quality fare. The trick, then, is to make the inmate responsible for his own cuisine.

We design the cabin accordingly, giving it a kitchen area with the usual: electric range, sink, counter, refrigerator-freezer, cookware, dishes, and cutlery (note that many items that would be unacceptably dangerous in a communal setting are innocuous in SSI). The inmate receives a package of raw foods once a week, with items he chooses from a menu, subject to nutritional and caloric guidelines. In such an open and ventilated environment an outdoor grill is a pleasant option.

Whatever rationale exists in conventional systems for inmate uniforms, there is no purpose in SSI for regimentation of wardrobe. A real choice of clothing should be made available to the convict, sturdy, simple, and colorful. The convict will be responsible for doing his own laundry by using the sink and a clothesline.

It is sobering to remember that one of the major goals of the legal struggles of recent decades has been to assure the inmate 60–75 square feet of cell space. Paradoxically, it may be much more expensive (cost of real estate aside) to fashion a secure and well lubricated prison environment in a tight space than in an ample one, just as the beehive is architecturally much more ambitious than the cumulative work of individually nesting insects.

Granted the dimensions suggested, SSI offers a cabin 4–5 times as large as a typical cell, and outdoor space 40 times as large. The ampleness of the space is the first step in making a full time confinement tolerable. More positively, the generous space is a canvas on which a convict can begin to fashion a new life by pursuing an almost infinite variety of interests. The inmate could paint and decorate the cabin to his taste. He could landscape and garden his plot. He could start a small fish farm, or raise other suitable creatures. He could be provided with a bench and weights, or be allowed to design and build his own exercise system. There is even room for a modest running track. Beyond the mundane, his fancy might lead him to painting or sculpture, music or photography, microscopy or astronomy.

Kits could be provided allowing him to learn the intricacies of engine design or canoe construction, electronics, carpentry, ceramics, jewelry making, or metalwork. He could design and make clothing, or learn the ins and outs of leather. A convict may choose to specialize in activities that are of use to the entire compound, such as the mending of clothing or shoes, vegetable gardening, or TV repair. A certain number of plots could actually be designed with such activities in mind.

In sum, there is a galaxy of labor-intensive craft that could become a great source of skill, pride, and money. A self-employable skill is particularly useful to a person for whom the stigma of criminality will inevitably be an impediment to normal employment.

Quite aside from the enormous expansion of possibilities with space, SSI sharply reroutes the preoccupations of the convict from social jungle skills to literacy and selfmastery. If a project is suitably engrossing, its cost will be small relative to the time needed to master it, not to speak of any possible financial value resulting from the product, or the value to society in usefully training a self-motivated convict. Whatever he chooses to undertake, the convict should be made to understand that his choice of projects, how he carries them out, how they express his attitude and development, will be crucial factors in consideration of early release. If the convict cannot muster enough discipline to do justice to his projects, we are right to be skeptical as to his prospects in the outside world. It would be salutary also if permission to begin a new project be made contingent on completion of the current one, absent a good reason for quitting.

There were attempts in 19th century penitentiaries to enforce total silence on prisoners, even during periods of congregation. Despite severe sanctions the urge to communicate could not be suppressed, and the attempts to institute a regimen of silence failed. As mentioned, the physical and verbal isolation of the Pennsylvania system was an even more disastrous failure. In SSI a variety of techniques, electronic and otherwise, is made available to avoid the disaster of the incommunicado prisoner.

We note that the prisoner's physical isolation in SSI is not complete,. since he has several immediate neighbors, and others within hailing distance. The key to expanding his contact with the rest of the prison, and to some extent the outside world, is the telephone, in its modern, technically advanced incarnation.

The telephone, firstly, will facilitate an arms-length relationship with prison custodians that is more efficient and less prone to abuse. It permits contact with corrections about most routine matters. If rules are such that calls from corrections must be answered, while other calls need not, the telephone should be equipped with distinct ringing sounds. All such conversations should be taped for use in official inquiries, if necessary.

Clearly, careful thought must be given to allowable uses of the telephone. Permitting unrestricted calls within the compound could easily result in much nastiness and harassment, especially if the facility contains rival gangs. Such problems could be monitored, in extreme cases, by automatic taping of conversations, and curtailed, if necessary, by instituting a system that allows the barring of calls between any two given phones.

Privacy concerns can be met by forbidding access to these tapes without cause and formal procedure.

On the other hand, in the absence of physical congregation, certain privileges should be considered, e.g., conference calls between three or more inmates, and calls to and from the outside world. Friendships with "phone pals" on the outside could be very beneficial. Volunteer programs involving correspondence or visits with concerned strangers exist in many systems today. A telephone friendship might appeal to someone who would never dream of visiting a penitentiary, and could be more satisfying and involving than correspondence. This sort of contact would need careful thought and monitoring. Perhaps only incoming calls might be allowed. Clearly, the telephone and monitoring methods mentioned heretofore, and later, are well within the abilities of currently available technology.

The uniqueness and novelty of SSI lies in the enormous number of options it offers those in charge of operating our prisons, all within a secure and genuinely decent environment. The optimal mix of these options becomes a matter of policy, not capability Money permitting, video technology presents a wide variety of possibilities for education, entertainment and therapy- Normal television (FIG. 4) (and radio) should be available to each prisoner. Programming can either be piped in from regular broadcasting channels, or specifically put together for the compound. Authorities might wish to limit viewing hours, to avoid creating couch potatoes. The calming effects of television on prisoners is well known. An article in the New York Times several years ago described the beneficial effects of TV in each cell of an upstate N.Y. penitentiary. It noted that convicts will walk away from fights rather than risk losing TV privileges. In SSI, while reducing aggressive affect is still valuable, the main point of TV would be to help maintain a psychological link with the outside world, and to ease the sting of isolation. A judicious choice of programming is made with an eye to fostering humane qualities in the convict while maintaining his interest.

The one key available to the convict that will open doors to the law-abiding life on a relatively advantageous level is an education. In Japan a convict serving a sentence longer than a year is not permitted to leave prison till he has achieved literacy. While educational opportunities are offered in current systems, either through in-prison classes or by correspondence, it is the rare inmate who is able to overcome the fearsome distractions of prison life and achieve something substantial. While the atmosphere in SSI will certainly be more serene, the logistics of providing instruction must be rethought.

One possibility in the absence of congregate classes would be televised courses, like those offered to insomniacs on public television. Alternately, live video lectures coupled with feedback via the phone system could allow a teacher to work with up to, say, 20 inmates at a time. The teacher controls a switchboard mechanism letting one or more inmates speak in a way heard by the entire class. More efficiently, a combination of taped lectures with occasional live classes to clear up problems could work well. Further remedial help, one on one, assisted perhaps by volunteer tutoring through the telephone, can be made available. Such remote instruction should attract a far wider pool of teachers and tutors than the current prospect of travelling to a penitentiary and dealing at close quarters with a roomful of convicts. A further convenience for someone considering such work is the possibility of conducting courses from anywhere in the country.

Computer hookups could greatly enhance educational and creative efforts for those inmates who can demonstrate the ability to profit from them. As in some prisons today, paid work can be made available to the inmate who develops computer skills. Simpler computer work, such as reservation or order taking, could be available to many more if such a system could be profitably instituted into the fragmented design of SSI.

Reading material can be distributed from a prison library. If an inmate wants to use a law library, the necessary volumes could be supplied to him, several at a time. With a computer hookup, of course, he could access law, and other, databases.

There has been a loss of faith among specialists and the public about the possibility of systematically rehabilitating criminals. A consequence of this disillusion, and of the singleminded priority of packing in as many bodies as possible, is the deep underfunding of psychological services. Nevertheless, mental disturbance is at least as prevalent in a criminal population as in the larger society, and being imprisoned does not help matters. Whatever the goals, therefore, therapeutic intervention will always be necessary at some level.

One of the obvious problems is that the professional counselor is viewed by the inmate as part of the prison establishment. As such, and because of the severe code of loyalty in a prison subculture, the convict, however great his need, is reluctant to turn to a therapist. The SSI system will clearly go a long way toward breaking the grip of the subculture on the individual convict, since he will be immune from physical intimidation. There is, therefore, the likelihood that the inmate will be more inclined to reach out for the professional help that is offered him. To the extent that therapy can be made more independent of correction goals, its prospects for helping the convict will improve.

Technically several therapeutic formats could be used in SSI. Group therapy could be conducted in the same way as a video-telephonic class, avoiding the complication of gathering and transporting prisoners. While not as ideal as a physical gathering, the popularity of telephonic therapy on radio talk shows around the country indicates some of its potential.

Individual therapy should probably be done in person, with the therapist visiting the inmate at his plot, since no time is saved by using the phone, and the face-to-face aspect is valuable. Unusual security precautions would be needed with only a very small percentage of inmates, in which case one possibility would be a conversation through the fence. In addition, a 24-hour hotline to trained help would be a useful service. Pastoral ministrations could be offered in a similar and parallel way.

Another idea to ameliorate prisoner isolation is the inmate-operated radio or television station, already a practice in some prisons. This would permit an exchange of individual ideas and complaints. Prison inmates are very ingenious at working out ways to adapt to difficult and unusual circumstances, and in the absence of congregation, the broadcast medium is a good way to share this lore. Broadcasting could also serve as a mode to improve communication between inmates and custodians, by means of appearances by the warden and other officials, who could address inmates directly, and perhaps permit interviews and calls from inmates.

Notables from all walks of society of interest to inmates could make similar appearances, perhaps in broadcasts covering many SSI facilities. Am in-house TV station would have wider possibilities than the radio format. Video teams could visit individual convicts with unusual projects, or whose thoughts are of special interest to other prisoners. Convict theatre groups could be organized and broadcast. Of course, such an enterprise would require a certain freedom of movement for those convicts operating the station. If such exceptions to isolation are deemed unwise, outsiders may volunteer, or be hired to run such enterprises.

Prison broadcasts would do much to ease isolation and enhance a useful sense of community. Nevertheless, the more dangerous possibility of arousing and publicizing the personal and group hatreds usually lurking below the surface of prison communities would need to be strictly curtailed by authorities. Stations functioning in prisons today present similar problems.

In a similar and less complicated vein, a prison newspaper is a useful outlet for communal and personal expression. Logistics are fairly straightforward in today's world of desktop publishing, networking and faxes, and, in principle, would require no physical movement outside plots.

It may be desirable to have a trained liaison person or ombudsman to coordinate all levels of contact between the inmate and the outside world. Such a case worker could handle, say, one hundred prisoners, and would be charged with developing a full understanding of the inmate's needs and problems, visiting him in person frequently, and maintaining a smooth two-way flow between the inmate, corrections, and the rest of his world. An ombudsman service independent of (or at least separate from) corrections would more likely be trusted and used by the inmate population.

As mentioned, a great blessing of SSI would be its elimination of disease contagion. Current prisons are so overcrowded, and often so unsanitary, that they are among the most contagious of all social environments. This has been a major element in the urgency and adamancy with which federal judges have declared many current facilities unfit. Especially frightening are the high incidences of AIDS and deadly, new forms of tuberculosis in many prisons, with both inmates and corrections personnel in severe danger. By eliminating this issue SSI improves the health and well-being of the convict, while reducing the medical costs attending incarceration. Creating contagion-free wings within the tight confines of today's congregate prisons has proved extremely expensive. The absence of contagion flows naturally from the design of SSI.

Another incidental benefit of SSI is the elimination of maddening levels of ambient noise. People visiting a penitentiary for the first time are astonished at the constant din: steel on steel, voice, music, screams, all within a harshly echoing architecture. The physical and mental toll of sonic stress are well documented. To fashion a life demanding the minimal level of tranquility needed for mental concentration within such an environment is nearly futile.

Another advantage of SSI is its sheer openness, access to light, and aesthetic superiority. While the prison yard may seem to offer the same qualities, it is a place fraught with anxiety and violence, a place where drugs are traded and scores settled. It is hard to enjoy the sky while watching one's back. Yard time may be cancelled in fog and bad weather. Whatever the benefits of the yard, most of the time spent by the inmate in a penitentiary is within closed, dark, small spaces.

It is a psychoanalytic cliche that real work on personality restructuring cannot begin in the maelstrom of crisis, of which current penitentiary life is a prime model. By contrast, SSI is an oasis of serenity.

To the extent that we still retain any hope that the convict emerges a better human being than when he went in, SSI offers a far richer set of yardsticks by which to measure his progress. His individual life, with its many choices, stands out vividly. He can speak and act without fear. Contrast this with the cowering conformity, the deep code of silence, the limited scope for learning and creativity, the endless marking of time we find in today's institutions. Most important, by offering him safety, space, and opportunity, society is in a position to demand measurable progress in return for consideration of early release.

More fundamentally, a convict will not be rehabilitated by a society whose institutions he does not respect, as a child will not learn from a parent who exudes fear and rigidity. Today's harsh edifices of concrete and steel do not convey strength and confidence. They are monuments to our helplessness and desperation. However much he suffers the convict senses this. Clutching sword and shield, we have no hand left to offer the inmate. We must find a way to go about things in a more relaxed and cheerful manner, and to seem to know what we're about.

SECURITY

As idyllic as this may sound, the SSI system must answer the stern question of security- Since almost half of all prisoners are in maximum-security facilities today, our system must be suitable for the most dangerous candidates. It is no problem, after all, to design low and medium security prisons that are pleasant and humane; such places already exist. Can the system outlined manage the dangerous felon? To answer this question we need to look at the overall design of the compound, and discuss appropriate security procedures.

The security philosophy of SSI is, very simply, that a sufficient number of relatively soft barriers and tripwires will in the end prove as effective as the fewer, more daunting ones used in current facilities.

The roads (FIGS. 1–3) separating the blocks should be arrow straight to afford an unobstructed view from one end of the compound to the other, and wide enough to allow two way access for patrols, emergency, and service vehicles.

Fencing the perimeter of the entire compound is necessary. A wide strip of soft sand with embedded sensors can be used to create an additional barrier short of the outer fence. Microwave, and other motion sensor technology above ground is also available.

Watch towers are preferably placed at intervals along the outer perimeter, at the ends of roads. In larger compounds, towers can be sprinkled throughout the interior of the prison, but not in such a way as to obstruct the view along roads.

Other security possibilities include the use of video cameras for monitoring roads not covered by towers. In fact, a sufficiently comprehensive video system could replace many of the manned towers. Replacement of manned towers by other means has been a trend in prison architecture, as the round the clock manning of a tower may cost as much as $120,000 per year. Interruptible light beams place along the roads and the outer fence, are another useful complication for the potential escapee. Convicts who are known escape risks should be placed in plots in the inner part of the compound, subject to more intensive surveillance. The larger the compound, the more problems an escapee would have even reaching the outer perimeter, what with towers, cameras, invisible beams, patrols, and potential snitches along the way. Roads, of course, should be lit at night.

In any case, these global aspects of securing a large compound are not all that different from those faced by many existing facilities, such as POW camps and sensitive military and industrial facilities.

Nevertheless, a double chain link fence, even one flanged and adorned with razor wire, does not present a serious escape barrier to a skilled and determined prisoner with access to a large amount of materiel. Whatever his problems in then making good his escape from the larger compound, it would be prudent to discourage or interdict him at the first line of defense, which is the fence around his plot. Once he is on the road, all sorts of unpalatable possibilities arise: hijacking of a vehicle, taking of hostages, entry to another plot with intent to harm, etc. After all, with all we are providing the inmate in his plot, it is impossible to prevent him from fashioning crude but effective weapons.

There are several options, in addition to surveillance of the roads, that could immediately alert authorities that a convict is outside his plot. If a convict is considered a serious escape risk (and only a small percentage are) he could be tethered physically, or electronically, within his plot. A light, flexible line containing a wire could be attached to his ankle so as to provide an uninterrupted signal to a security station, yet allowing unimpeded movement within the plot. Alternately, if the sort of radio ankle units being experimented with for house arrests today are deemed reliable, they could serve the same purpose as a tether, with less restriction. With certain lower security prisoners, tethers might even be a cheap alternative to fencing. Both monitoring methods are well within current technical means.

Despite these concerns, it is at least clear that each escape from each plot would remain a separate problem, even if coordinated among several prisoners. With the entry systems for the plots being properly designed, an escapee on the road could not easily assist others out of their plots before security personnel arrived on the scene. Consequently, the classic prison riot scene is hard to envision in SSI. Aside from the decreased motivation due to genuinely benign conditions, the feasibility of arranging a conspiracy by telephone, especially monitored telephone, is doubtful. Absent too is the incendiary atmosphere of angry congregating convicts, a key to the process of raising the level of reckless consensus. Finally, there is the absence of large structures within which rioting convicts can barricade themselves, and the lack of easy access to guards for use as hostages.

As discussed later in this document, SSI facilities will find their most natural location in the emptier and more remote parts of the nation. This remoteness is a natural enhancement of security, especially if there are few public roads within easy reach. In case of an escape, transportation routes in remote areas are far easier to monitor, and carry far less traffic, than most roads near current prisons.

From a security viewpoint, the relative self-sufficiency of the convict within his plot is a major advantage, in that physical entry of guards into the plots, and their more general intrusion in his life, can be kept to a minimum. For most inmates, deliveries are a simple matter of asking the inmate to step back, opening the door and putting things down. For a few inmates, additional simple precautions may be called for. If official entry to a plot is necessary, and there is concern about the reaction of a dangerous, and possibly armed convict, a handcuff could be inserted on a pole, and the convict instructed to cuff himself. If he refuses, the guards know they are dealing with a confrontation and can respond accordingly.

Another potential problem is the smuggling of drugs or other contraband via food and other shipments to the plot. This could happen with the complicity of guards, or of the people preparing the packages. This problem can be minimized if certain precautions are taken. Grocery shipments should be delivered only on a regular, scheduled basis in sealed, standardized cartons. The people preparing the shipments should be given each order with a special prisoner code number, changed every week, so that preparers do not know who gets what. A preparer must sign his name to a shipment, which should be specially sealed, so that responsibility can be ascertained if a later spot check turns up contraband. A Careful system needs to be put in place for non-regular deliveries of supplies or project materiel. All said, there is no a priori foolproof way to exclude contraband. But this problem has not really been solved in any existing prison system. Mail, of course, presents similar problems, and the procedure for dealing with mail need be no different than in a conventional facility.

In any case, distribution of contraband among convicts is much harder in SSI. In a conventional prison drugs and other illegal items reaching key convicts are quickly and efficiently distributed, with the result that in many systems drugs are more freely available than on the street. (The best estimates are that one third to one half of all prison inmates use drugs on a regular basis, often daily.) In SSI these items would have to be smuggled to each inmate separately. Admittedly, a tossing-over-the-fence network is conceivable, but it would require unbroken complicity along its entire length, and risks being seen.

Since, in SSI, guards are not permitted casual contact with inmates, the smuggling game would become much more dangerous and inefficient. Moreover, if contraband does get through the overall impact on prison security and society is less severe, owing to the separation of the convicts.

Perhaps the greatest deterrent to the importation of drugs and other dangerous items into SSI is the understanding on the part of the convict that he has so much more to lose if he is caught. Random drug testing, for instance, can be very effective, and if it cannot be forcibly imposed legally, it can, perhaps, be made a condition of privileges and early release.

As mentioned, visits by guards or other personnel to convict plots should be minimized, and when necessary, properly authorized and logged. To the extent possible, all necessary communications between authorities and prisoner should be handled by telephone, and these conversations automatically recorded. This will minimize abuse and provide a clear record for any necessary inquiries.

All the foregoing emphasize the enhanced level of dignity and privacy the ruleabiding inmate may enjoy in SSI. In current penitentiaries, what an inmate does, or hides, in his cell directly endangers others when he congregates. Thus, his private space is mercilessly violated, his cell and person being subject to search at any time, day or night. In SSI there is much less necessary concern about an inmate's activity in his space, and less need for intrusion- This can only lend a precious dignity and significance to his circumscribed life.

It is not too much to expect that a system successfully replacing random horror with predictable justice will bring about a profound change in the morale and makeup of corrections personnel. This component of our criminal justice system is one of the most demoralized, and does not attract the best candidates we could ask for. I believe that SSI can result in corrections becoming a far safer, more dignified, more interesting profession, with less of an emphasis on combat readiness, and more on relational talents. Female staff, whose present opportunities in higher security institutions are limited, could be employed with much less concern in SSI. In the end, the key to guard welfare is fair inmate treatment.

Lastly, while I feel strongly that all kinds of prisoners with substantial sentences should enjoy essentially the same quality of life in SSI, the level of security may be modified in the name of savings. In a minimum security version of SSI a single fence around each plot would suffice, the outer perimeter could be minimal, watchtowers are unnecessary, and far fewer personnel are needed for security purposes. Such variations in plot security may also be structured into one compound, without otherwise creating differences in the lives of inmates. The savings engendered by less fortified facilities, and the consequent segregation of inmates along security lines, should be weighed against the wonderfully homiletic effect of making neighbors of the rapist and the Medicare swindler.

ANCILLARY FACILITIES

A part (not illustrated) of the compound is preferably reserved for corrections and support personnel within the outer perimeter, but separated by its own security perimeter. These facilities will roughly approximate those of existing penitentiaries, with additions and modifications dictated by the more unique features of the SSI design.

These facilities may include, among others: housing for corrections personnel, offices, phone centers, supply and food warehouses, vehicle storage structures, punitive isolation cells, broadcasting facilities, medical facilities, and dining halls.

SIZE, LOCATION, AND POLITICS

A fundamental change in the design and nature of American prisons would have major political, social, and financial implications. Because such issues affect the construction and operation of the invention, a discussion of these issues is warranted Clearly, SSI requires more space than a conventional penitentiary, especially those found today in the more populated eastern states. Let us make some cursory calculations. While other geometric arrangements are possible (such as circular ones), the following is the most efficient in terms of space and service.

A compound consisting of plots forty feet by eighty feet, separated by double fencing with four foot gaps, in blocks of sixteen (eight by two), laced with twenty foot roads, would create blocks of about 64,000 square feet. Adding each block's share of roadway swells this to 80,000 square feet. A facility of 5000 inmates, about par for the largest penitentiaries in existence today, would need 313 blocks, or about 0.90 square miles. If we increase this area by a third to accommodate support facilities and buffer terrain around the entire compound (perhaps an excessive allowance), we get about 1.2 square miles, or a square about 5783 feet on a side, or 768 acres. Compounds many times this size, while perhaps undesirable for other reasons, would not require a 33% addition for support facilities.

Sticking with our calculation of 1.2 square miles per 5000 inmates, the space required for one million inmates, a worthy initial target, comes to 240 square miles, the equivalent of a square 15.5 miles on a side. In a land of 3.6 million square miles, this does not seem outlandish- Nevertheless, it is plain that land may be needed on a larger scale than is practical in some of the smaller and more densely populated eastern states; aside from the expense and sheer unavailability of such large tracts in these states, community opposition to large prison compounds is usually strenuous. The disparity between these calculations, however, and figures often given for current penitentiaries (in the dozens of acres) is somewhat misleading, since these figures often do not include the sometimes substantial buffer terrain around these facilities.

It is therefore reasonable to consider locating these large facilities in the more remote parts of the nation, where federal and state wastelands are plentiful. Here political sensitivities can become acute. We are essentially asking those states with relatively low crime rates and spacious skies to accommodate hordes of miscreants from the rest of the country. By what right can we expect such an accommodation?

There are several approaches to an answer. I will use the mountain states as examples, though other states too are plausible candidates. Firstly, the resource-based economies of these sparsely populated states are in deep recession, with some of the lowest per capita incomes in the country. Some have barely held their population levels. There has even been talk of creating a huge national park spanning major portions of these, and some of the plains states. Here we are proposing the establishment of a major new industry whose construction and support will give these languishing states a major economic transfusion. This industry will be non-polluting, recession-proof, and calls for large amounts of land, a resource these states abound in, and may be located in areas so remote as to have little impact on the existing populations.

As for the stigma of becoming a dumping ground for the worst problems in the rest of the country, a different view is urged. If SSI can fulfill its promise, Montanans will be doing far more to preserve the security of our country by embracing it than they have ever done by making a home for ICBM's.

If push comes to shove, we note that many of these states are substantially (some primarily) federal land, and as such, belong in large part to the American people, not solely the residents of the respective states. While the concerns of local residents should properly be taken into account, policy decisions concerning national forests, BLM lands, and such are made in Washington and not in state capitals.

In addition, the current spate of military base closings present new opportunities for alternate uses, including SSI. There are several military bases and testing ranges in California and Nevada, for example, that are each far larger than anything we would need for all of SSI.

Nellis AFB in Nevada, in the news recently because of the doleful state of its wild horse population, is over 3000 square miles in area. Another possibility are the severely depressed Native American reservations, for whom SSI would be an economic godsend.

While I feel strongly that many states will find it in their interest to vie for SSI it is worth pointing out that the mountain states each encompass terrain on the order of 100,000 square miles. Any one of them could swallow up the several hundred square miles needed for all of SSI without a hiccup.

Mollifying those states that can accept SSI will not be the only issue. By transferring to SSI, we are proposing the dismantling of a system in parts of the country employing many thousands of people, and constituting an important economic resource to their surrounding communities. Considering how difficult it has been to close absolutely useless military bases around the country, the resistance to such a dislocation should not be minimized.

There are many possible forms the political arrangements can take, once it is clear that SSI works and a national consensus for it grows, and they will emerge from the legislative process in a way that need not be foreseen in this discussion. For example: the national government could contract space for those states not blessed with ample terrain, or states could work out bilateral deals under overall federal mandate. The simples: possibility is the creation of a federal agency that would become jailkeeper (prisonmaster) for the states. A process could ensue whereby the federal government establishes the system and states join it as they think fit.

A further problem, of course, is that current state prison systems are deeply rooted in local prerogative and tradition, not to mention greatly varying levels of per capita outlay. It can be imagined that the creation of a new system with nationally uniform standards will be greatly resisted by local prison establishments.

VISITOR ACCESS, COST

With remote locations, visiting the inmate becomes a problem. Visitor access has never been a great priority to those designing and locating prisons. For instance, visitors of inmates located near the Canadian border in upstate New York, in a facility owned by New York City, face a ten hour bus ride from the city, each way. In SSI, as we shall discuss later, visitation can become a much more fruitful part of prison life, and more emphasis needs to be given to access.

A bold solution: build jumbo jet air strips near very large compounds (or build compounds near the many local airstrips that could be enlarged for jumbo traffic), and offer subsidies sufficient to lower the cost of flights to reasonable levels. With proper organization, these flights will always be full, and quite regular. Under such circumstances the cost could be brought down drastically even in the absence of a subsidy. Assuming minimal luggage, planes can be designed with more passenger space, allowing further savings.

Even with the easy availability of such flights, it might be desirable to ensure that no visitor need fly more than, say, two and a half hours to visit an inmate. It would therefore be worthwhile locating several substantial compounds east of the Mississippi. This should be possible in at least half a dozen states, especially if we allow for the razing of current outdated facilities. Compensation for states able to locate compounds is possible. The construction work and service system should also be an attractive incentive. There is value in making such an effort as widely national as possible.

What of the cost? Current costs for new penitentiaries of the fortress variety are upwards of $100,000 per cell. A floating jail barge recently purchased by New York City with dormitories for 700, and cells for 100, cost $200,000 per convict-space. SSI is so different in structure and function from any existing facility that even a crude cost extrapolation from current facilities is impossible. But viewing the cost of erecting a livable house in a remote area today, and assuming severe simplicity, pre-fabrication, and mass production, it would be surprising if a large compound could not be constructed at under $75,000 per plot, and a prisoner maintained at under $20,000 per year. One alternative is to construct the complete cabin in a factory, ship it to the site, and plug it in to pre-installed utilities in the manner of mobile homes and small log houses. The commissioning of a detailed study of various alternatives and their cost would be the next step in the implementation of SSI.

One of the keys to reducing costs in the SSI system is reducing personnel. There are today about 200,000 prison and jail employees. With greater convict autonomy and less microsupervision common sense indicates that (on a sufficient scale) SSI is less labor-intensive than the standard penitentiary. Sweden has a system in which most parole and probation personnel are civilian volunteers working under the supervision of a small core of professionals. Perhaps many of the non-security aspects of SSI could be handled in much the same way, organized in a way similar to the Peace Corps- Any method that narrows the grim distance between prison life and the larger society would be beneficial for both sides In addition it is possible to consider drawing on those serving misdemeanor and other terms too short for installation in SSI for the labor needed in the standard servicing of SSI. Dormitories and support facilities, such as food-packaging warehouses, could be located adjacent to SSI compounds for this purpose, or at more convenient locations central to several compounds.

A novel success story at the Delaware Correctional Center indicates a way to achieve great savings in the construction of SSI. Phil Eaton, a former contractor, currently serving a life sentence for a crime of passion, has trained a cadre of convicts in the building of prisons. This crew, currently 80 in size, has saved the state $25,000,000 over nine years. In the process, over 400 prisoners have received valuable training, policing themselves impeccably.

It is close to a hundred years now that the union movement has effectively put a stop to substantive prison labor, though commercial prison enterprises do flourish quietly in many state systems. While reintroducing convict labor openly and massively might provoke great outcry, using carefully chosen prisoners in the construction of SSI could make a huge difference in its affordability. Here too, the distinction between SSI and the fortress-type penitentiary is crucial. Small teams of prisoners could be trained to put together unit after unit of plots (assuming extensive and shrewd pre-fabrication). The level of complexity and skill needed is much lower with SSI than for a penitentiary, quality standards could easily be checked and maintained, mistakes would not have the same financial or security implications. A suitable carrot and stick approach, and a sense of competition, could propel work crews to high levels of skill and motivation and provide them with a wide range of usable skills when they are released. In addition, such teams could handle subsequent maintenance of structures and utilities. The success of the Delaware experiment shows that self-construction and self-maintenance can work, save money, and be politically feasible.

Careful design and planning is essential to extend these small-unit assembly techniques to the more complicated electrical, plumbing, landscaping and road work. Nevertheless, the effort should be made to train a prison construction cadre extensive enough to enlarge the system to whatever size is called for, beehive fashion.

Not to be ignored is the level of enthusiasm that may be generated in a public that is offered a system that actually works, and that is not a source of national shame. One can expect, under such a circumstance, an outpouring of generosity in the form of furniture, clothing, and dozens of other fruits of our throwaway society that are usable in SSI. Current penitentiaries allow little scope for such philanthropy. Prisoners who show an authentic facility at any sort of craft will find the American generosity emergent. This sort of direct contact with segments of society other than corrections can itself be immensely beneficial for the moral attitude of the convict.

By combining all categories of prisoner in SSI, including the white collar criminal, another source of funding opens up. Any prisoner, to the extent of his means, may be required to pay up to the full per capita cost of the system, if not more. Also, since the design of SSI permits a host of personal luxuries, a steep tax, say three times the value of an item, can be imposed, no questions asked, to permit its importation. This will not only bring a lot of money out of hiding, but would be a good way of mitigating the envy of indigent prisoners. Voluntary contributions, of course, should be funnelled only to poor prisoners.

SOCIAL ISSUES WITHIN SSI

A certain basic simplicity is maintained if the inmate is not permitted to leave his plot except for some urgent medical or administrative purpose. There might be ways to relax such a stringent rule without compromising the system. On occasion, for instance, a small group of friends might be permitted to gather at a particular plot. Allowing, say, up to a dozen pals to party (or conduct religious services) for a few hours once a month could become a highly valued social event. More significantly, while under current arrangements people are in perpetually enforced contact, snarling at each other like rats in a crowded cage, occasional voluntary gatherings could give even hardened social misfits a different outlook on the meaning of human contact. It could make them yearn all the more for a normal life outside the penal system, and help them draw the proper conclusions about the value of criminality. Thus we have a system that, rather than fostering the accumulation of anger over years of vicious entrapment, provides an environment benevolent enough to leach anger, but deprivational enough to occasion yearning for something better—a real life.

Such gatherings should be spread throughout the week and confined to daylight hours. They should be given serious consideration in spite of the security headache of searching and transporting prisoners and monitoring their gathering.

Another social question is raised by SSI's enhanced capacity to absorb visitation. A common result of current prison life is the crumbling of outside relationships that the inmate may depend on for his emotional well-being. SSI can slow this deterioration.

Allowing one or more visitors into an inmate's plot, after suitable security check, is quite feasible, and seems more humane and potentially fruitful than the classic conversation through glass. The issues of conjugal and extended visitation arise. Since the debate in penology over the wisdom of conjugal visitation remains quite unsettled, the question rears up equally unsettled in SSI. Nevertheless, the technical superiority of SSI in absorbing conjugal visits is obvious. SSI permits quite extended stays of wife or lover (or father, grandparent, brother, mother, or friend) without undue strain or hazard. Again, known gang or criminal associates should be barred from visiting or contacting the inmate.

The potentialities of this system are so novel that such issues should be discussed and experimented with, in my view, only after the system has achieved some track record on a more conventional level. The extraordinary flexibility of SSI should greatly widen the debate on these social aspects of incarceration.

From the block geometry in this proposal, it is clear that each prisoner (except for those at the corners of the block) has five immediate neighbors, and several more within hailing distance across the road. This raises problems and opportunities. Adjacent placement of friends would certainly be better than proximity of likely antagonists. Problems may arise that would necessitate separation of proximate inmates, or the removal of an inmate who is a pest to his neighbors. Persistent harassment and complaints could become a chronic problem if careful thought is not given to proper placement of inmates. Perhaps an inmate should be given the right to erect opaque or translucent shielding on the fencing between one or more of his neighbors, though this might hamper surveillance in the compound. In any case, common neighborly courtesy must become a cornerstone of the rule system at the facility.

With the decline of the "trusted inmate" hierarchy, the radical change in racial composition of prison population, and the advent of gangs and "super-gangs", it remains more true today then ever before that inmates run prisons. That will certainly change with SSI, especially with a few additional measures. Gang members should be thoroughly dispersed, to prevent the intense pressure on the system that might result from their concentration, and to allow individual members to develop the sort of life and attitude SSI is meant to encourage. Under no circumstance should gang identity be allowed to entrench itself in SSI. Gatherings, visits, and even phone contact between members should be denied.

Various attempts at a careful social mixing of male and female prisoners have been made at certain minimum and medium security facilities around the country, with some positive effects reported. Confining men and women in the same SSI compound is a possibility that warrants discussion and experimentation.

It is said that the effect of prison subculture on a prisoner stays with him all his life. That this influence, in its present form, is not in society's interest is an understatement. SSI can promise a major loosening of this attachment, and from this point of view alone it is worth the change.

PUNISHMENT

Even absent physical contact between prisoners, troublemaking will not become a lost art. There will still be many activities governed by rules and prohibitions: destruction of property, harassment of neighbors (by voice or phone), creation of hazardous or unsightly conditions, excessive noise, protocol and obligations toward corrections personnel, escape attempts, etc., etc. A clear code of punishment needs to be in place, drawing on several methods: deprivation of benefits, adjustment of sentence, and more severe isolation.

Prisoners can be deprived of any of the enormous numbers of benefits and privileges they enjoy. Food can become bland and unvarying. The hot water, TV, and phone can be shut off. Materiel necessary for favorite activities or projects can be removed or withheld. Joining inmate gatherings and receiving visitors can be painful privileges to lose. With very long sentences an increasing possibility, reduction of sentence for good behavior (and their extension for severe infractions) become even more potent tools.

If all else fails isolation in bare cells, the common practice in existing facilities, will do nicely. In SSI, an area should be set aside for rows of attached concrete cells with bed, sink and toilet. As a tool of punishment bare isolation will work better in SSI than in current penitentiaries because the contrast with the normal prison regimen is more vivid. Life in punitive isolation should be as discouraging as possible, without being vicious. A recent article described a warden who had devised a loaf of bread, nutritionally complete yet deeply bland and untasty, that can be fed to the recalcitrant indefinitely, with nothing but water.

For many prisoners today, especially the more sensitive, the vicious jostle of penitentiary society is not clearly to be preferred to isolation, however maddening and unbearable isolation can become. Today prisoners who are in danger from other prisoners often spend entire prison terms in isolation. (For such prisoners, the change to SSI does not even have the debatable drawback of loss of congregation.)

In SSI, on the other hand, unless a prisoner has a particular point to prove, or is basically masochistic, he will have every reason to avoid isolation, and will yearn to hurry back to life on his little plantation. It is reasonable to expect that the discipline situation in SSI will be similar to that in minimum security prisons today; rarely will the fortunate inmate risk being sent to a more unpleasant setting by acting up.

An exception to this rosy scenario is that most recalcitrant of prisoners, known in the literature as the "disturbed, disruptive inmate." This difficult person, whether too mentally disturbed to respond appropriately to rational carrots and sticks, or too mentally deficient to handle the much larger amount of personal initiative and responsibility offered and demanded by this new system, simply cannot be accommodated in SSI.

Such difficult cases don't seem to fit into any institution today. They don't quite need permanent hospitalization, they can't fit into prison society, they destroy themselves in isolation. Nothing is more disconcerting than a person who needs enormous amounts of help, yet is rational and criminal enough to be truly difficult and dangerous. Neither SSI nor current penitentiaries can deal effectively with such people, or even contain them properly. They are often shuttled back and forth between prison and hospital. Clearly, society will have to be very motivated and financially generous to deal effectively with the "mad and bad."

While such people (and others severely disturbed, but less violent) seem outside the scope of the system proposed here, one can hope that the successes engendered by SSI could give us the courage to deal with these unfortunates with an energy and generosity that today's harassed prison system cannot begin to muster.

WIDER ISSUES

A prison system affects not only its inmates. It plays a vital role in society at large, as a vital component of the criminal justice system, as a deterrent to potential criminal acts, and in the perception of the public as to whether, and how well, justice is being done. It is a profound symbol of social attitude; one can learn much about a society from the way it punishes. A discussion of the benefits of the SSI system with respect to these roles and attitudes follows.

The advantages of SSI, from our discussion till this point, are summarized:

1) A safe, non-predatory environment.
2) The shattering of prison subculture.
3) A relaxed, ample, and aesthetic environment.
4) Scope and means for creativity and self-improvement.
5) The dignity of simple possessions and privacy.
6) Reduced contact and conflict with custodians, and of the corruption such contact makes possible.
7) Control of disease contagion.
8) Extended visitation capabilities.
9) Novel and wholesome social possibilities.
10) A wider spectrum of punishment and reward.
11) A system that will not burden the conscience of our society.
12) Reduced per capita cost.

Beyond all this there are issues of class and fairness in our dealings with crime and criminals. One source of inequity is the widely varying quality of institutions, even at comparable security levels. Causes of variation in quality are many: state philosophy and financial capacity; variations in existing physical plants (some states are still using prisons built in the previous century). If a fresh start is to be made it would be profoundly valuable, for the appearance of justice, that it have uniform standards and specifications, especially since a federal or regional arrangement is probably the only practicality. A particular source of bitterness and cynicism among underprivileged prisoners is the (valid) perception that white collar and n-fiddle class prisoners get better treatment. Judges, in fact, are extremely reluctant to place such non-violent criminals into penitentiaries because of the feared destructive effect, and because space is tight even for dangerous offenders in these more expensive institutions. Thus, crimes that society would dearly like to treat seriously, such as the mayhem of drunk driving (the cause of as many deaths as homicide), it cannot. It would be invaluable to have a uniform system to which all transgressors could be sent, without fear of anyone being brutalized. No better declaration of our commitment to equal justice could be made than to embrace a system in which a corporate embezzler is treated the same as a robber or rapist-and all are treated decently. As easy as they are to administer, minimum security "country-club" prisons should be abolished. They are a debasement of justice.

It is clear from all the foregoing that our system can be made quite palatable to the typical inmate, especially compared to the dark nightmare of current penitentiary life. We are faced with the ironic question: is this system too much of a good thing? Can the prospect of SSI deter? What can the homeless and decent poor of this country think about a felon being provided with free home, land, food, and many services? Will there not be many an honest citizen who would consider a sojourn at such a facility quite a respite from a difficult life? Many an undisciplined writer might plausibly salivate for such a regimen.

Here we run up against the essential contradictions of modern penal policy. After all, can we really hope to devise a system sufficiently painful to deter the hardened criminal, humane enough not to grate on our social conscience, clever and involved enough to induce significant rehabilitation, yet cheap enough to permit the removal from circulation all those we wish to incapacitate? Do we really expect all this from a coercive institution?

I submit that SSI goes further in promising to fulfill these contradictory criteria than anything that has come before it. If we reject SSI on the indictment of excessive pleasantness we must finally admit that the pointless horrors of penitentiaries are not unfortunate side effects, but exactly what we intended all along, consciously or not.

As to deterrence, the question separates into several parts, since the prospect of confinement can mean very different things to different people. Will SSI deter the average citizen, occasionally tempted by a criminal opportunity? Those seeking to escape hopelessness and poverty? And most crucially, will it deter the urban monster and his lesser criminal cousins?

Beginning with the last question, with some reflection, we may see that SSI, despite its attractions, is not something a typical felon would want to look forward to for long periods of time. Most hardened criminals need to pester their fellow human being. Deprivation of this pleasure, so abundant in today's prisons, is itself a serious infliction. The typical prison inmate is in his mid-twenties. Pumped up as he is with youthful energy and testosterone, SSI deprives him of any outlet for violence, while enforcing on him exactly the setting he needs to cultivate the skills and habits of self-discipline lacking in the average young criminal. This transformation, we may rest assured, will be sufficiently painful.

Resisting the transformation will be even more painful. After all, persisting in a state of rage and aggression, for lack of outlet, will only increase the pain of incarceration. The more easily a convict can absorb himself in useful preoccupations and healthy self-reflection, the happier he will be. Thus virtue and its reward go hand in hand in SSI.

While the social sense of the typical criminal may be quite warped, his capacity to be content alone is not markedly better than that of the average citizen. This dependency is even keener for the Mafia or gang member, whose very identity is defined and nourished by the group. For such, SSI will prove acutely punishing by effectively severing these links. For such also the prospect of SSI will severely diminish the allure of joining a criminal gang in the first place. Today, going to prison often means no more than visiting with the local prison branch of the gang.

The average, middle class citizen, occasionally tempted by a criminal opportunity, has more to lose than the habitual criminal. SSI, however congenial, is far more restrictive and lonely than life on the outside, especially by his, more human, standards. For this sort of person the shame and indignity of incarceration, not to speak of the permanent stigma of a criminal record, will bite deeply. Studies have shown that even the most hardened felons are not immune to the pain and indignity of the rejection by society that prison represents. This "respectable" criminal, looking around himself in SSI, will see the sort of company society deems him fit to keep. SSI will not lightly become a chic getaway for the middle class.

As for our society's tormented and downtrodden, SSI does seem to offer an appealing bargain. First let me say that my impression of the poor in America, in all their variety, is that few of them would welcome permanent confinement as an alternative, however much it may appear to improve their circumstances and security. (The mentally ill cannot, in any case, be offered a berth in SSI.)

The best approach to this disturbing question is to acknowledge its cogency, and grant its logical consequence. If SSI seems a reasonable way to treat a punishable felon, how complacent can we be about the failed lives in our midst simply because they do not pose a criminal threat? The end result of this line of thought is clear. To offer the criminal, our least deserving, a humane, enriching environment is to begin the process of setting a lower limit to the wretchedness of life in this country. That this will require wiser and more determined intervention is clear, but if we wish to eventually develop a society where crime is actually unnatural, rather than simply contained and deterred, we will need to march down this road anyway. Any success we have with criminals, our most difficult citizens, will give us precious courage to once again tackle the problem of poverty seriously.

Technically, a version of SSI, absent most prison security features, could be constructed to house the indigent. I find the prospect of such an installation for the poor very unwise and unappealing. I mention it as a ramification of this invention, in the technical sense, with no endorsement of its desirability.

It should be also pointed out that much about America's current reluctance to attack the problems of poverty stem from its resentment and preoccupation with crime. It is not easy to generate sympathy and generosity for social environments that are breeding both crime and poverty. Our disposition to help the poor will improve to the extent that we develop control over the problem of crime.

As for the rational rascal who see-ks several years in SSI for whatever reason, and is willing to accept the stigma of a criminal record . . . well, he may be an unavoidable cost ! of the system. There may, however, be several steps we can take to make his ploy less palatable. We could make the absolute minimum sentence in SSI rather longer than the prospective vacationer or convalescent from life might savor—say three real years. It may in fact turn out that any realistic progress on the part of an inmate in a place like SSI cannot be achieved in less than three, or more, years. If that is so, society may wish to adjust sentencing policy to reflect this fact, irrespective of the severity of the offense.

In addition, we can adjust our laws so that juries can take this calculating motive into account as an aggravating circumstance, subjecting the suspect to a sentence more severe than he anticipated. Further, if a determination is made that the inmate committed his crime for the sole purpose of entering SSI, he can be forced to endure his sentence without many of the more palatable features of the system, and the cost of his stay can be made to burden any future income.

For that matter, there is a case to be made that a careful, systematic, non-vindictive layer of deprivation can be imposed on SSI without derailing its essential philosophy. This parallel regimen can serve as a constant reminder to the inmate as to why he is there. It may consist of periodic, prison-wide, impositions of any of the measures used as punishment in individual cases. Or we may demand that the inmate earn the many pleasures and privileges of SSI through genuine achievement and progress (though this sort of constant subjective judgement is open to abuse). It is important that the prisoner not forget that, however benign his circumstances, and whatever other purposes his incarceration serves, he is also the subject of society's righteous anger. I believe a strong case has been made that SSI is a more effective classroom for such a lesson, precisely because of its fairness and decency, than current penitentiaries.

American political opinion is sharply divided concerning the proper response to crime. Those on the left hope that as prisons become more brutal and unmanageable, the country will turn to greater reliance on intensively supervised parole and probation. Those on the fight feel that the safety of society should take precedence over the comfort and well-being of the convict, and even more criminals should be packed into today's crowded systems. They further reason that underclass life is so appalling that there can be no deterrent impact unless life in prison is substantially worse.

I believe that the American people rightly hold both these extremes to be unrealistic. Nobody knows how to systematically rehabilitate criminals, regardless of the resources available. The human is a stubborn creature, as both dictatorships and religious institutions have discovered. On the other hand, most convicts get out eventually. How they behave on the outside is substantially affected by their life in prison. This is only common sense. There is no point in treating the convict with gratuitous sadism. Ultimately, SSI should please both liberal and conservative, the former for its essential decency, the latter for its promise to rid the streets in a way the public can accept in its conscience and pocketbook.

SSI may be the first prison system that can be practically expanded to the point where there is room for every serious criminal in our society. It may be the first prison system that can reasonably promise that its residents will emerge better people than when they entered. SSI may therefore hold to the key to an outcome America has almost lost any hope of achieving: effective control of its crime problem.

A truly satisfactory prison system could completely rejuvenate the rest of the criminal justice system. Once prison capacity is in place, we can concentrate on enlarging the police and court systems, and implementing effective sentencing policies. The threat of longer sentences would give us much greater leverage and control over those on probation and parole, making these institutions more effective. Jail crowding would be eased, as emptied penitentiaries will be available for short sentences and jail space. Prosecutors, under less pressure from swollen dockets, will be able to cut tougher deals, as suspects know that judges and juries will not squirm at long sentences in SSI.

The average state prison term today is about thirty months. There are fewer than Six imprisonments per one hundred reported crimes. Both crime and prison population are at record levels. From statistics such as these it is reasonable to surmise that far fewer than half of all habitual criminals are behind bars at any given time. If we can actually arrive at a situation where most criminals in America are behind bars then those youngsters facing the choice of the criminal life would truly have something to mull over. As more and more criminals are put away, police and court efforts can more effectively bear down on the fewer that are left. It is likely that, initially, SSI will bring about even further increases in prison population. But eventually, since each component of the justice system reinforces other parts, we may look forward to large drops in prison population, as a consequence of a sharp drop in crime.

Of course, the criminal justice system cannot be the entire answer to crime. The social realities that breed crime are real and well-described, and their elimination is not beyond human effort. The best approach to crime, therefore, is not a choice between liberal and conservative convictions, but a common sense intensification of both. In other words, come down very hard on criminals, putting many away for longer, but also intervene strongly in our inner cities, offering those struggling with a fateful choice of direction a graspable vision of the good, clean life. The more credible the chasm between the clenched fist and the open hand, the fewer who will choose to confront the fist.

SSI, of course, is more than a clenched fist. It is a message to the potential violator that he will not be given an endless number of chances, but that society will help him make the most of the few that he is offered. Again, our first concern is protection of society. An inmate who violates our faith through recidivism should understand that the benefit of the doubt will be in favor of his hypothetical future victim, and he will have to remain in prison till he is old enough to no longer be a danger to society.

An air of medieval scholasticism permeates the debate about the causes and nature of crime. Most of us just want it to end, and society has a perfect right to make that its first priority. If SSI can succeed in helping us toward this goal, we may eventually be able to return to the law-abiding citizen that most precious of constitutional liberties, freedom from criminal victimization—a liberty perhaps so fundamental and obvious, like the right to air, that it needs no enumeration. The terrifying absence of this liberty in America makes a mockery of our dreams and self-image as a nation. In light of these wider issues, the further advantages of SSI are clear:

13) A chance to create a system with uniform, equitable standards.

14) A system that permits the equal, and decent, treatment of both white collar and violent criminals.

15) A system that will deter both embezzler and armed robber without resorting to unjust and random horror.

16) A system that promises to give a harassed criminal justice system the strength and breathing space to deal effectively with an out-of-control crime situation.

17) A system that will encourage us to face effectively the social conditions that breed crime.

18) A system with the potential for healing the sharp political divisions that paralyze social policy.

What I claim is:

1. An arrangement for providing self-sufficient incarceration comprising a central control and a plurality of dwelling units each for housing an inmate, each dwelling unit including means enabling the housed inmate to care for his basic needs, such means comprising means for storing and preparing food, a water supply for food preparation, cleaning, and personal hygiene, each dwelling unit comprising a dwelling structure and an adjoining area of land open to the weather and freely accessible to the unit occupant, a barrier surrounding each dwelling unit for confining an occupant to within said each unit, said barrier including a portal having externally controlled lock means, and a centrally controlled communications means providing controllable and monitorable communication to and from each dwelling unit.

2. The arrangement of claim 1 wherein said dwelling units are organized into a compound interlaced by a road system which affords access to dwelling units, and a segregated area for the use and housing of security personnel and custodians of the compound.

* * * * *